US006059640A

United States Patent [19]

Stearns

[11] Patent Number: 6,059,640

[45] Date of Patent: May 9, 2000

[54] CRYOGENIC DEFLASHING APPARATUS

[76] Inventor: David T. Stearns, 2414 Calle Zaguan, Santa Fe, N.Mex. 87505

[21] Appl. No.: 09/014,699

[22] Filed: Jan. 28, 1998

[51] Int. Cl.[7] ..... B24C 3/26

[52] U.S. Cl. ..... 451/85; 451/87; 451/89

[58] Field of Search ..... 451/85, 86, 109, 451/113, 104, 87, 89, 95, 96, 449; 241/DIG. 37

[56] References Cited

U.S. PATENT DOCUMENTS

| | | | |
|---|---|---|---|
| 3,041,787 | 7/1962 | Schnetzer | 51/9 |
| 3,086,278 | 4/1963 | Fuchs | 29/90 |
| 3,797,174 | 3/1974 | Hazlewood | 51/9 |
| 4,312,156 | 1/1982 | McWhorter . | |
| 4,524,550 | 6/1985 | Burke et al. | 51/424 |
| 4,648,214 | 3/1987 | Brull et al. . | |
| 4,979,338 | 12/1990 | Schmitz, II et al. . | |
| 5,018,312 | 5/1991 | Steckis | 51/164.1 |
| 5,584,747 | 12/1996 | Ikeda et al. | 451/83 |
| 5,676,588 | 10/1997 | Frederick et al. . | |
| 5,782,677 | 7/1998 | Kanouse | 451/85 |

*Primary Examiner*—Timothy V. Eley
*Assistant Examiner*—Dung Van Nguyen
*Attorney, Agent, or Firm*—Ray G. Wilson

[57] ABSTRACT

A cryogenic deflashing apparatus removes residual flash from molded articles. A cryogenic chamber establishes and maintains cryogenic temperatures from an injected cryogenic fluid. A parts basket is removably disposed within the cryogenic chamber for imparting a tumbling action to the molded articles. The basket has an external perforated shell and an open end and a closed end, where the closed end has a conical surface disposed within the perforated shell effective to enhance the tumbling action for the molded articles for exposure to the cryogenic temperature for embrittling the residual flash. A throw wheel directs shot media toward the articles tumbling within the parts basket for impacting and removing the residual flash from the articles that is embrittled by the cryogenic temperature.

23 Claims, 4 Drawing Sheets

CRYOGENIC DEFLASHING APPARATUS

FIELD OF THE INVENTION

This invention relates to apparatus for removing residual flash from molded articles, and, more particularly, to portable apparatus for removing residual flash from molded articles at cryogenic temperatures.

BACKGROUND OF THE INVENTION

When parts are produced by a molding process, the molded article frequently has residual material that is extruded at mold interfaces, which is referred as residual flash material or "flash." This flash must be removed in a finishing operation. One technique that can be used to remove flash is machining and/or hand trimming, which is expensive and time consuming. It is frequently possible for small articles to use a shot blasting operation where the shot impacts the relatively thinner flash and removes the flash without significant damage to the underlying article. See, e.g., U.S. Pat. No. 5,676,588, U.S. Pat. No. 4,648,214, and U.S. Pat. No. 4,312,156, incorporated by reference, for basic teachings on flash removal.

One approach to shot blasting for flash removal uses the property of many materials to become embrittled at low or cryogenic temperatures. For example, many rubbers and plastics become brittle at temperatures obtained from cooling by evaporating liquid nitrogen in the material surroundings. Since flash is conventionally very thin, the flash will be cooled to brittle temperatures before the body of the material so that the flash will be readily removed by shot blasting that does not damage the article.

In order to be effectively cooled and exposed to the shot, articles are conventionally placed in a rotating drum so that the articles are continuously picked up and dropped from rotating projections, or "flights", in the drum. It is conventional to place the rotating drum at an angle to enhance the tumbling action of the flights. The design of conventional drums causes some articles to aggregate in the downhill comer of the drum, with a resulting loss in deflashing of the articles.

The deflashing shot is expelled by a throw wheel that accelerates the shot through an opening in the housing that contains the rotating basket and into the rotating basket. Conventional throw wheels have an even number of vanes for accelerating the shot and are subject to harmonic vibrations which reduce the life of the equipment Further, the expended shot merely collects in the bottom of the housing, which can impede the rotation of the drum and which requires a large supply of shot.

A particular problem for operating deflashing apparatus at cryogenic temperatures is the design of adequate seals for closures and for rotating shafts that penetrate the cryogenic housing. Conventional closure seals are formed of materials that become brittle at the operating temperature of the cryogenic deflashing apparatus or that become stuck together through freezing of ambient water vapor. Seals for rotating shafts, and the like, also become brittle at cryogenic temperatures with a limited operating lifetime or excessive leakage of the cooling nitrogen.

Conventional cryogenic equipment is generally provided as a fixed device. With fixed devices, batches of manufactured must be diverted from the production line to the devices, unless many of these devices are provided integral with the production lines. It would be desirable to provide portable deflashing apparatus that can be readily moved when a production line is not in use.

These problems are addressed by the present invention and an improved deflashing apparatus is provided. Accordingly, it is an object of the present invention to provide a rotating drum that maintains the articles in a continuous movement in the drum for improved flash removal.

Another object of the present invention is to provide for the reuse of shot to reduce the quantity of stored shot that is required.

Still another object of the present invention is to improve the flow of shot to the throw wheel and to reduce vibration in the throw wheel.

One other object of the present invention is to provide improved seal designs for operation at cryogenic temperatures.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the purposes of the present invention, as embodied and broadly described herein, the apparatus of this invention may comprise a cryogenic deflashing apparatus for removing residual flash from molded articles. A cryogenic chamber establishes and maintains cryogenic temperatures from an injected cryogenic fluid. A parts basket is rotatably disposed within the cryogenic chamber for imparting a tumbling action to the molded articles. The basket has an external perforated shell and an open end and a closed end, where the closed end has a conical surface disposed within the perforated shell effective to enhance the tumbling action for the molded articles for exposure to a shot media. A throw wheel directs shot media toward the articles tumbling within the parts basket for impacting and removing the residual flash from the articles that is embrittled by the cryogenic temperature.

BRIEF DESCRIPTION OF THE DRAWINGS

The accompanying drawings, which are incorporated in and form a part of the specification, illustrate embodiments of the present invention and, together with the description, serve to explain the principles of the invention. In the drawings.

DETAILED DESCRIPTION

Figure 1:
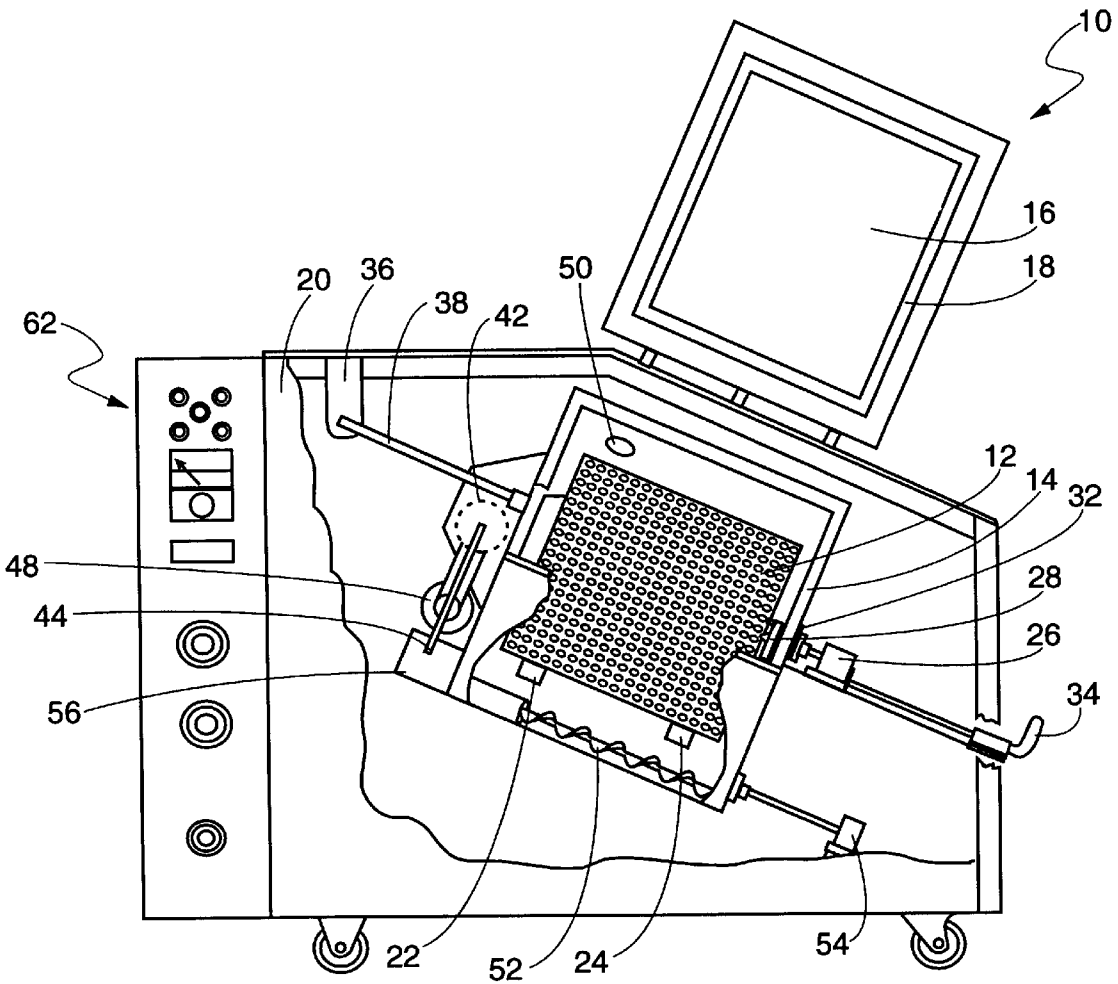
FIG. 1 is a pictorial illustration, in partial cut-away, of a cryogenic deflashing apparatus according to one embodiment of the present invention.

Referring first to FIG. 1, there is shown a pictorial illustration of a cryogenic deflashing apparatus 10 according to one embodiment of the present invention. Parts basket 12 is provided to receive articles having flash from a manufacturing operation. Parts basket 12 has an open end for inserting and removing manufactured articles and a closed end for contact with a driving mechanism. Parts basket 12 is removably and rotatably mounted within insulated cryogenic chamber 14, and is preferably mounted within cabinet 20 at an angle with respect to horizontal to better tumble the articles for exposure to a stream of cryogenic fluid and shot for removing the flash. Basket 12 may be rotatably supported by bearing supports 22, 24, which are preferably formed of a material that maintains lubricity at cryogenic temperatures, e.g., polytetrafluoroethylene (PTFE) such as teflon®). U.S. Pat. No. 4,979,338, incorporated herein by reference, describes many of the basic components of a cryogenic deflashing apparatus.

Load door 16 includes a seal 18 for sealing against chamber 14 to provide an enclosed environment for the cryogenic deflashing. Parts basket 12 is engaged by drive wheel 28, which is turned by the shaft of drive motor 26 that extends into cryogenic chamber 14 through seal 32. Hand clutch 34 (e.g., De-Sta-Go, Model 6.0, from Rutland Tool, Houston, Tex.) is connected to slidably translate motor 26 and drive clutch 28 to engage basket 12 and to urge the open end of basket 12 against bearing surfaces 64, 66 (FIG. 5) mounted on an opposed wall of chamber 14. Bearing surfaces 64, 66 are sized to provide a tolerance between the end of basket 12 and the wall of chamber 14 that does not permit the parts to escape from basket 12 during the deflashing operation.

For the cryogenic deflashing operation, a cryogenic fluid, such as nitrogen ($N_2$), is controllably introduced by solenoid valve 36 though feed line 38 into cryogenic chamber 14 and basket 12. The fluid vaporizes and expands to cool the articles in basket 12 toward the temperature of the fluid. The gas exits through vent 50 in cryogenic chamber 14.

A suitable shot media, such as plastic pellets, is also introduced into basket 12 by the action of throw wheel assembly 42. Shot media is fed from shot media basket 56 though feed line 44 onto the vanes of a throw wheel, described below, in throw wheel assembly 42. Motor 48 rotates the throw wheel at a high speed, e.g., 1,000 to 10,000 rpm, for accelerating the shot media into basket 12.

In accordance with one aspect of the present invention, expended shot and finite removed flash pass through perforations in parts basket 12 into the bottom, or sump, of insulated chamber 14. Removed flash pieces that are larger than the perforations in basket 12 remain contained within basket 12 and are removed with the parts. Finite flash particles pass through the perforations and simply circulate with the shot medium, as discussed below. Such finite flash particles are comminuted to very small particle sizes, e.g., dust, and are eventually removed with the cryogenic gas through vent hole 50. These materials are moved by auger 52, driven by motor 54, to media basket 56 for return to throw wheel assembly 42.

It will be understood that a complete cryogenic deflashing apparatus includes numerous sensing and safety components which are conventionally provided in the art and are not discussed herein for purposes of clarity. Control panel 62 provides for controlling the temperature of the operation, the speed of rotation of the various components and for monitoring the condition of the overall system as is well known in the art.

In a particular embodiment of the present invention, the above components are kept to a minimum size to permit portability of the deflashing apparatus. Cryogenic chamber 14 is kept to a minimum size by continuously moving shot media and removed flash from the sump of the chamber. The use of auger 52 and direct feed of shot media from hopper 56 to throw wheel assembly 42 minimizes the size of the feed system, where conventional feed systems use many external components. Finally, control panel 62 is mounted directly on cabinet 20 so that the entire system is self-contained. Portability is obtained without significantly reducing the size of parts basket 12 since the surrounding and supporting components are reduced in size without affecting the deflashing within parts basket 12.

Figure 2:
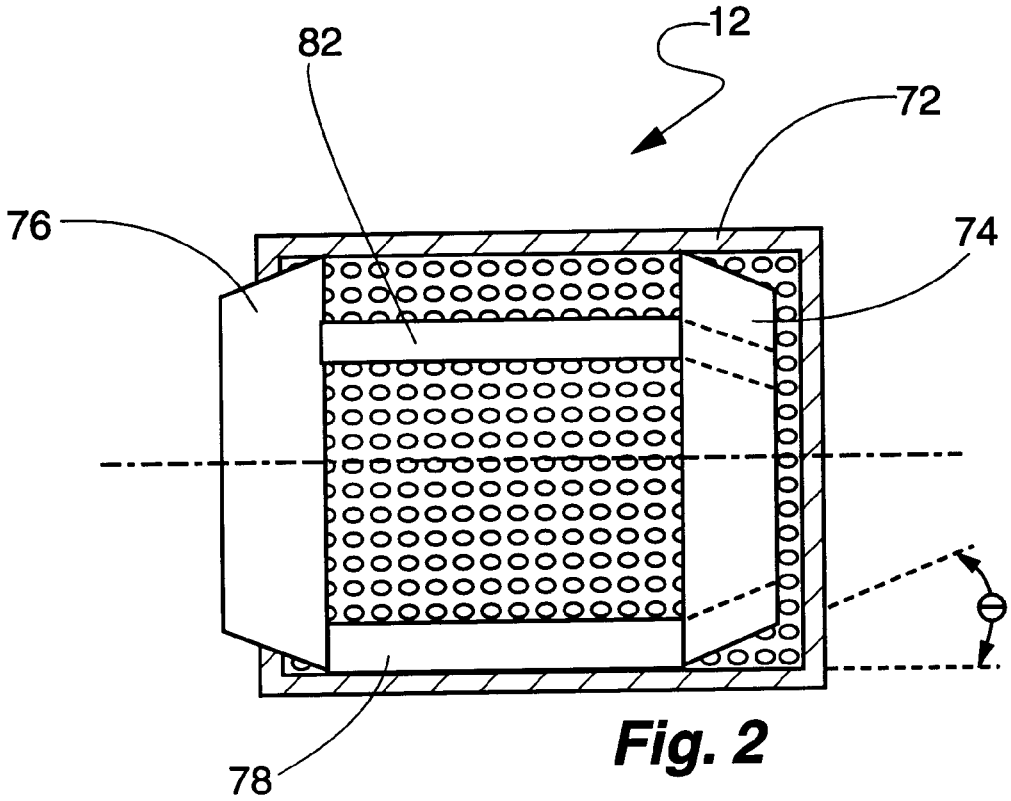
FIG. 2 is a cross-section of a rotating deflashing drum according to one embodiment of the present invention.

In a particular aspect of the present invention, parts basket 12 incorporates particular improvements as shown in cross-section in FIG. 2. Perforated shell 72 is provided to conventionally permit expended shot and removed finite flash to fall from within basket 12. The purpose of parts basket 12 is to tumble the parts for deflashing, i.e., to keep the articles of manufacture falling within the volume defined by shell 72 as much as possible to maximize exposure to both the cryogenic fluid flow and to the accelerated shot. In conventional baskets, the articles tend to accumulate in comer portions of lower basket volumes as the basket is rotated and many articles are not sufficiently deflashed.

In the present invention, conical deflector shell 74 acts to keep the articles from accumulating in the lower corners and to maximize the fall time of the articles. Conical angle θ with respect to the surface of perforated shell 72 is selected at the closed end of basket 12 to provide the bottom of deflector shell 74 in a nearly horizontal position when the axis of parts basket 12 is installed at an angle θ within cabinet 20 with respect to horizontal. An angle in the range of 20°–25°, with a preferred angle of 22°, has been found to best tumble articles while preventing accumulation of the articles in the bottom of shell 72.

A second conical shell 76 is provided at the open end of shell 72 to direct the cryogenic fluid and the deflashing shot along shell 72 to dislodge articles from shell 72 for falling within the enclosed volume. Conical shell 76 acts to retain the tumbling parts within shell 72. A preferred angle for this shell is 30°.

Tumbling action within perforated shell 72 is caused by flights 78, 82, which are deflector ribs that extend parallel to the axis of shell 72, except within conical shell 74, where the flights are parallel with the side of shell 74. A preferred number of flights is three (3) in order to maximize flight times without too much churning of the enclosed articles. The action of the angled basket 12, conical deflector shell 74, and flights 78, 82, along with the impacting action of the shot media causes the particles to circulate in a "figure 8" pattern within shell 72 to provide an enhanced time of flight for flash removal. It will be appreciated that each new article configuration requires some experimental regime to determine the best rotation speeds for parts basket 12 and throw wheel assembly 42 for optimum flash removal.

Figure 3:
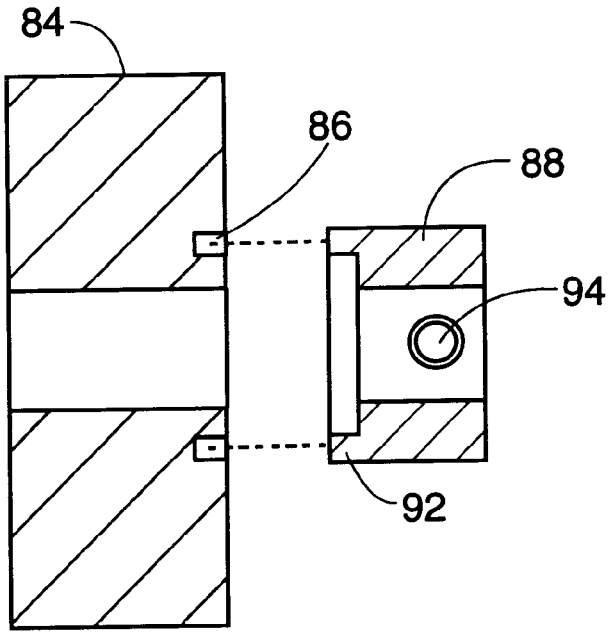
FIG. 3 is a cross-section of an improved rotating seal for use in the apparatus shown in FIG. 1.

As shown in FIG. 1, there are penetrations into cryogenic chamber 14 for rotating shafts, e.g., the drive shafts for parts basket 12 and for auger 52. These penetrations must be sealed to prevent the loss of cryogenic fluid from the cryogenic chamber. Conventional sealed bearings do not perform well at cryogenic temperatures and it is a feature of the present invention to provide low leakage cryogenic bearings, as shown in FIG. 3. Bearing block 84 is attached to the stationary component and seal block 88 is attached to a rotating shaft, e.g., by set screw 94. Bearing block 84 defines concentric seal groove 86 and seal block 88 defines concentric seal extension 92 that mates with seal groove 86. Extension 92 and groove 86 are in bearing contact and form a high resistance path for any fluid leakage therethrough. Suitable materials will be materials that have a low sliding coefficient of friction at cryogenic temperatures, such as PTFE.

Figure 4:
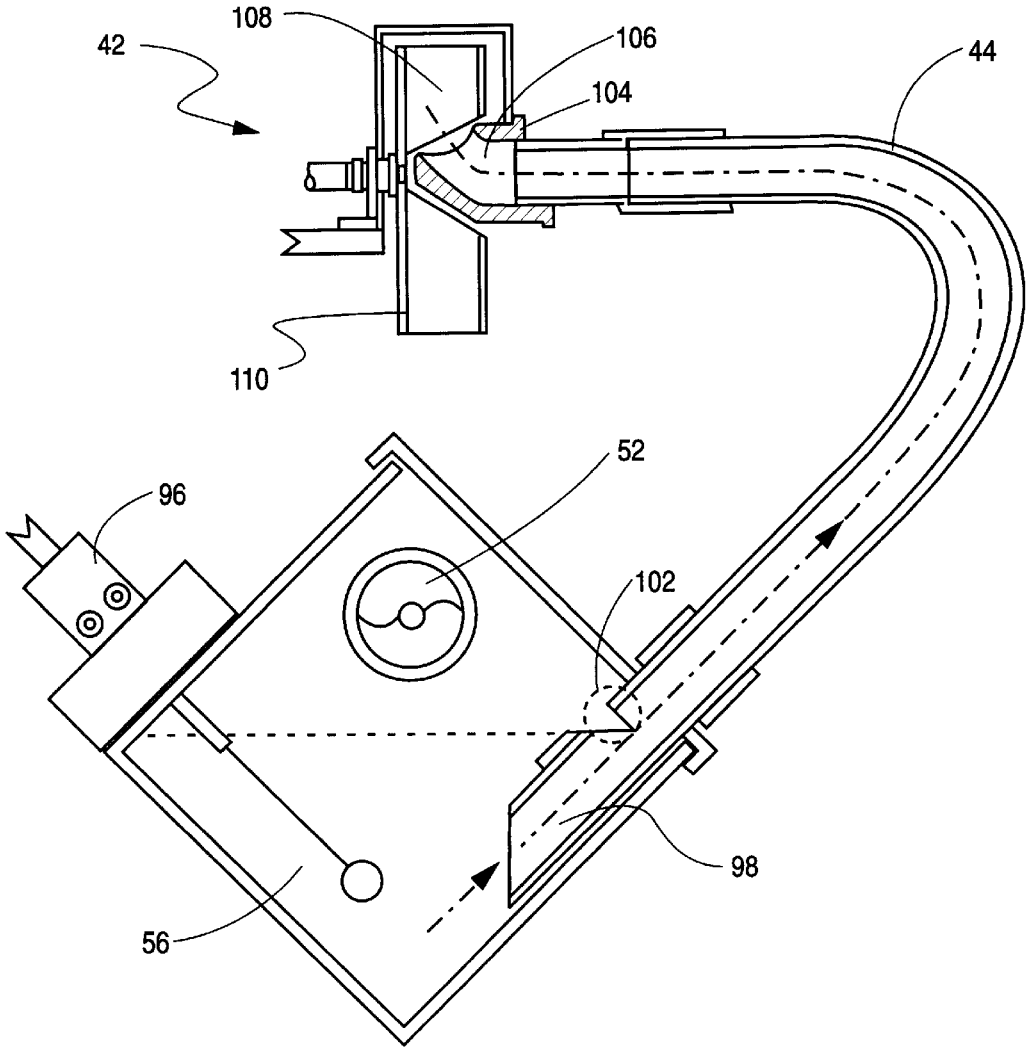
FIG. 4 is a pictorial illustration of a throw wheel and feed control cage for use in the apparatus shown in FIG. 1.

The present invention further incorporates improvements in the shot media feed system to provide a smooth flow of shot media onto the parts in parts basket 12 (FIG. 1). FIG. 4 more particularly depicts a shot media feed system in accordance with one embodiment of these improvements. Auger 52 pushes expended media from the sump of cryogenic chamber 14 (FIG. 1) into media hopper 56. Media level control switch 96 controls auger drive motor 54 (FIG. 1) to maintain a selected shot media level within media hopper 56. The action of throw wheel assembly 42 creates a pressure differential for delivering shot media to throw wheel 110 through feed line 44. Shot media enters into pick-up tube 98 through a first opening below the level of the shot media in hopper 56 and is delivered to feed line 44. Pick-up tube 98 is preferably provided with flow metering port 102, which is above the level of the media in hopper 56. Port 102 acts to prevent media blocking within pick-up tube 98 and provides a smooth delivery of shot media to throw wheel 110 rather than a pulsating flow that is obtained without flow metering port 102.

The shot media system described above is based on a system described for FIG. 1, where removed flash is generally retained within a parts basket. In one alternative embodiment, the removed flash is dropped through the basket perforations into the sump of the cryogenic chamber and picked up with auger 52. Then the flash must be separated from the shot media. Since the removed flash will be larger than the shot media, separation is readily done by delivering the material from the auger onto a vibrating screen so that the shot media passes through the screen into hopper 56 and the flash is moved into a flash container by the vibratory motion of the flash on the screen.

Shot media is delivered onto vanes 108 of throw wheel 110 through feed port 106 of flow control cage 104. The rate of delivery of shot media onto vanes 108 is controlled by varying the rotation speed of throw wheel 110. Feed line 44 is preferably formed of a transparent material so that media flow may be observed and the rotation of throw wheel 110 adjusted to maintain feed line 44 about half full of media.

Flow control cage 104 mates within rotating vanes 108 to deliver shot media directly onto vanes 108 for acceleration into parts basket 12 (FIG. 1). Flow control cage 106 has a frusto-conical end for extending within vanes 108 In a preferred embodiment, the frusto-conical end of flow control cage 104 defines feed port 106 at an angle of about 60° relative to the axis of throw wheel 110 to efficiently load shot media onto each vane 108 as the vane passes feed port 106. In another preferred embodiment, throw wheel 110 has an odd number of vanes 108, e.g., 5 vanes rather then the conventional 6 vanes, to reduce harmonic vibration at the high rotation speeds.

Figure 5:
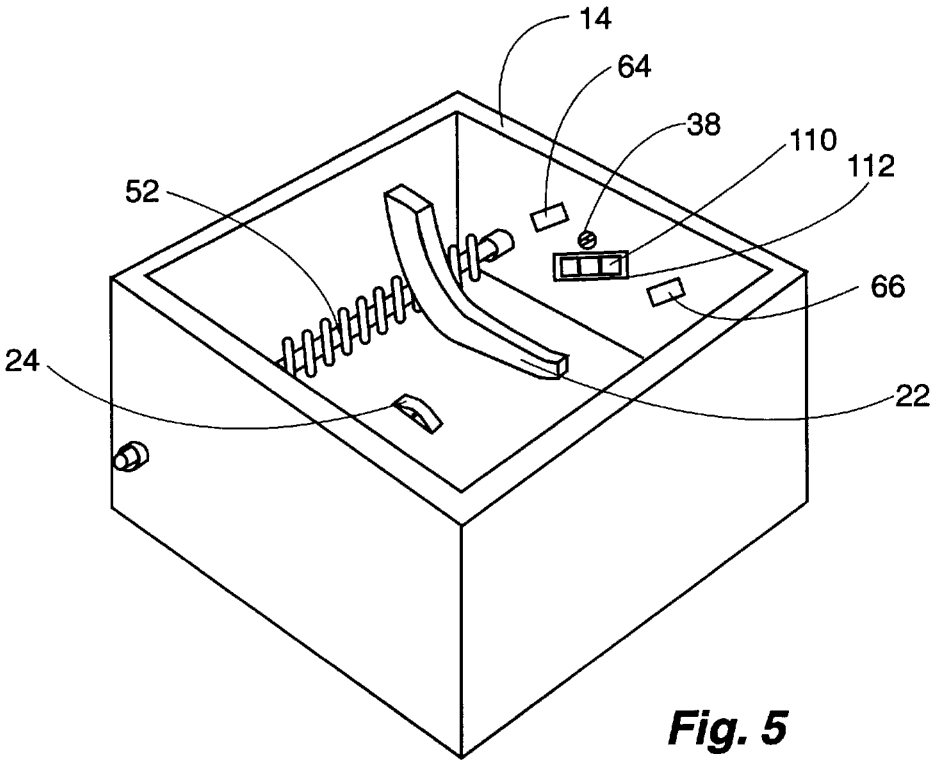
FIG. 5 is an isometric view of a cryogenic chamber assembly with the parts basket removed.

FIG. 5 is an isometric view of cryogenic chamber 14 with parts basket 12 (FIG. 1) removed The relative positions of auger 52, bearing surfaces 22 and 24, and cryogen feed line 38 are illustrated for reference. Shot media exits throw wheel 110 through an exit port 112 defined by a wall of cryogenic chamber 14. Exit port 112 is offset with respect to the center line of rotation of parts basket 12 to direct the shot media toward the volume of basket 12 where the articles begin to flip off of the flights, e.g., flights 78, 82 (FIG. 2) in the rotating basket. The impact of the shot media with the articles acts to deflash the articles and also to maintain the parts in a falling pattern for maximum exposure.

Figure 6:
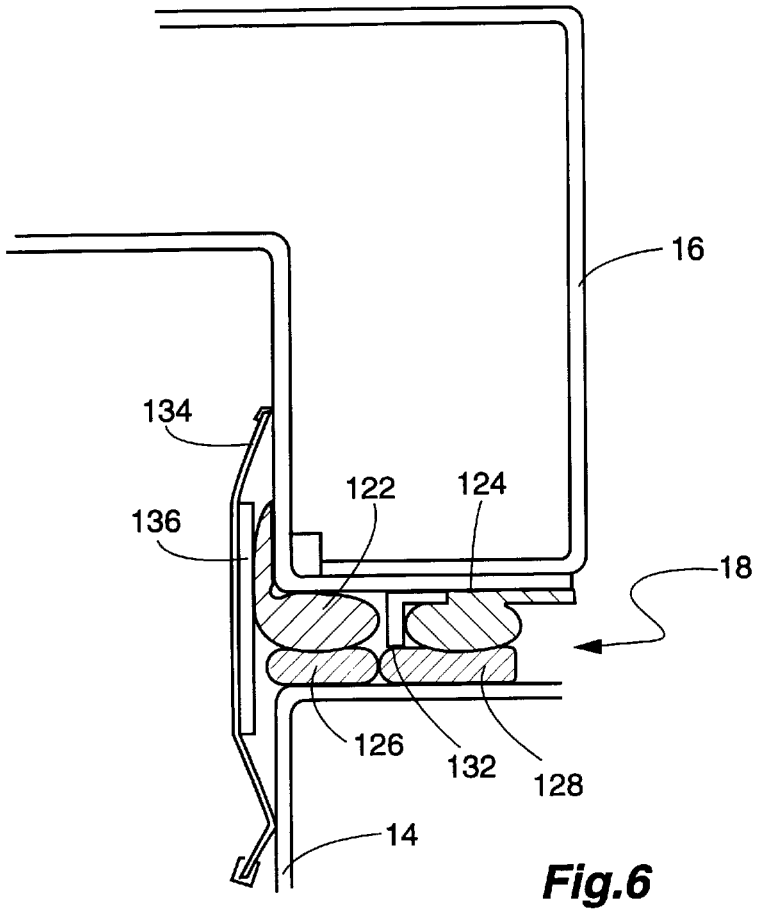
FIG. 6 is a cross-section of a seal design for use at cryogenic temperatures to seal the cryogenic chamber of the apparatus shown in FIG. 1.

In another aspect of the present invention, shown in FIG. 6, an improved cryogenic seal 18 is provided for sealing between load door 16 and cryogenic chamber 14. With conventional seal designs, ambient water vapor may penetrate the seals and freeze so that opening a sealed door may be difficult. The seal design shown in FIG. 6 alleviates this problem. Internal tadpole seal gasket 122 and external tadpole seal gasket 124 (e.g, tetraglass seals from Darco, Independence, Va.) are fixed to load door 16. Seal gaskets 126 and 128 are provided on cryogenic chamber 14. Spring loaded seal 134 with insulation 136 acts to protect the door seal components from erosion from the constant impact of the shot media.

Inner seal gasket 126 is preferably formed of a material that does not stick to frozen water vapor, e.g., PTFE, so that any ice formed between gasket 122 and gasket 126 will not cause the parts to adhere together. External gasket 124 is preferably formed of a sponge neoprene material. A barrier seal 132, such as aluminum, is formed between internal gasket 122 and external gasket 124 to minimize the contact of water vapor with mating seal gaskets 122 and 126 and to minimize the exposure of gaskets 124 and 128 to cryogenic temperatures. The combination of components provides a seal that opens readily during operation of the cryogenic deflashing apparatus.

The component parts of the present invention, described above, cooperate to provide efficient removal of flash from molded articles. The overall operation of the deflashing apparatus is best described with reference to FIGS. 1, 2, 4, and 5. Parts basket is removed from cryogenic chamber to load manufactured parts having flash to be removed. The parts are loaded through open conical shell 76 and parts basket 12 is placed within cryogenic chamber 14 supported by bearing surfaces 22 and 24. Hand clutch 34 is operated to translate motor 26 and drive wheel 28 for operatively engaging parts basket 12.

Load lid 16 is closed and sealed and motor 26 is energized to rotate basket 12 at a selected speed while a cryogenic fluid is introduced through feed line 38 to cool the parts to a suitable cryogenic temperature for embrittling the flash. Throw wheel 110 is brought to a speed for accelerating a shot media through shot opening 112 into basket 12.

The rotation of basket 12 with internal flights, such as flights 82 and 78, operates with conical shell 74 at the closed end of basket 12 to maintain the parts in a flight pattern whereby the parts do not aggregate in a comer of basket 12. Further, shot opening 112 is offset to direct the shot along an interior surface of basket 12 and toward a location in basket 12 where the parts begin to fall from the included flights so that parts are exposed to the deflashing shot media for a maximum time. The accelerated shot media also impacts the parts to further maintain the parts in flight.

Expended shot media and removed flash pass through perforations in parts basket 12 into a bottom portion, or sump, of cryogenic chamber 14. Auger 52 is energized as necessary to move shot media into media hopper 56 for reuse by throw wheel 110. The speed of rotation of throw wheel 110 is adjusted to maintain a suitable delivery of shot media to parts basket 12 through pick-up tube 98. Flow metering port 102 acts to prevent blocking of pick-up tube 98 so that a continuous flow of shot media is obtained. The delivery of shot media onto vanes 108 of throw wheel 110 is smoothed by the angle of feed port 106 in media flow control cage 104.

The foregoing description of a cryogenic deflashing apparatus according to the present invention has been presented for purposes of illustration and description and is not intended to be exhaustive or to limit the invention to the precise form disclosed, and obviously many modifications and variations are possible in light of the above teaching.

The embodiments of components of the deflashing apparatus were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A cryogenic deflashing apparatus for removing residual flash from molded articles comprising:

a cryogenic chamber for establishing and maintaining cryogenic temperatures from an injected cryogenic fluid;

a parts basket rotatably mounted within the cryogenic chamber for imparting a tumbling action to the molded articles, the basket having an external perforated shell and an open end and a closed end, where the closed end has a conical surface disposed within the perforated shell effective to enhance the tumbling action for the molded articles for exposure to a shot media and the open end has a conical shell effective to retain the articles within the basket;

a throw wheel for directing the shot media through said open end of said parts basket and toward the articles tumbling within the parts basket for impacting and removing the residual flash from the articles that is embrittled by the cryogenic temperature; and a door for the cryogenic chamber having an inner seal that is protected from the shot media in the cryogenic chamber and has at least one seal surface that does not adhere to ice.

2. A cryogenic deflashing apparatus according to claim 1, wherein the conical surface is at an angle of about 20° to 25° relative to the perforated shell of the basket.

3. A cryogenic deflashing apparatus according to claim 1, wherein the conical surface is at an angle of about 22° relative to the perforated shell of the basket.

4. A cryogenic deflashing apparatus according to claim 1, wherein the cryogenic chamber includes an entry port for delivery of the shot media to the parts basket that is displaced from an axis of rotation of the parts basket to direct the shot media along internal surfaces of the parts basket perforated shell.

5. A cryogenic deflashing apparatus according to claim 1 wherein the throw wheel has an odd number of vanes for accelerating the shot media within the parts basket.

6. A cryogenic deflashing apparatus according to claim 1, wherein component parts of said apparatus are sized to permit movement of said apparatus between production lines for said molded articles.

7. A cryogenic deflashing apparatus for removing residual flash from molded articles comprising:

a cryogenic chamber for establishing and maintaining cryogenic temperatures from an injected cryogenic fluid;

a parts basket rotatably mounted within the cryogenic chamber for imparting a tumbling action to the molded articles, the basket having an external perforated shell and an open end and a closed end, where the closed end has a conical surface disposed within the perforated shell effective to enhance the tumbling action for the molded articles for exposure to a shot media;

a throw wheel for directing the shot media through said open end of said parts basket and toward the articles tumbling within the parts basket for impacting and removing the residual flash from the articles that is embrittled by the cryogenic temperature; and a system for reuse of the shot media, including an auger disposed in the cryogenic chamber for returning expended shot media from the cryogenic chamber to a collection basket for return to the throw wheel.

8. A cryogenic deflashing apparatus according to claim 7, wherein the conical surface is at an angle of about 20° to 25° relative to the perforated shell of the basket.

9. A cryogenic deflashing apparatus according to claim 7, wherein the conical surface is at an angle of about 22° relative to the perforated shell of the basket.

10. A cryogenic deflashing apparatus according to claim 7, wherein the shot collection hopper includes a pick-up tube having a first opening therein below a level of the shot in the hopper and a second opening above the level of the shot for smoothing the delivery of the shot media to the throw wheel.

11. A cryogenic deflashing apparatus according to claim 7, wherein the cryogenic chamber includes an entry port for delivery of the shot media to the parts basket that is displaced from an axis of rotation of the parts basket to direct the shot media along internal surfaces of the parts basket perforated shell.

12. A cryogenic deflashing apparatus according to claim 7, wherein the throw wheel has an odd number of vanes for accelerating the shot media within the parts basket.

13. A cryogenic deflashing apparatus according to claim 7, further including a door for the cryogenic chamber having an inner seal that is protected from the shot media in the cryogenic chamber and has at least one seal surface that does not adhere to ice.

14. A cryogenic deflashing apparatus according to claim 7, wherein component parts of said apparatus are sized to permit movement of said apparatus between production lines for said molded articles.

15. A cryogenic deflashing apparatus for removing residual flash from molded articles comprising:

a cryogenic chamber for establishing and maintaining cryogenic temperatures from an injected cryogenic fluid;

a parts basket rotatably mounted within the cryogenic chamber for imparting a tumbling action to the molded articles, the basket having an external perforated shell and an open end and a closed end, where the closed end has a conical surface disposed within the perforated shell effective to enhance the tumbling action for the molded articles for exposure to a shot media and the open end of the basket has a conical surface within the perforated shell effective to retain the articles within the basket;

a throw wheel for directing the shot media through said open end of said parts basket and toward the articles tumbling within the parts basket for impacting and removing the residual flash from the articles that is embrittled by the cryogenic temperature; and a system for reuse of the shot media, including an auger disposed in the cryogenic chamber for returning expended shot media from the cryogenic chamber to a collection basket for return to the throw wheel.

16. A cryogenic deflashing apparatus according to claim 15, wherein the conical surface is at an angle of about 20° to 25° relative to the perforated shell of the basket.

17. A cryogenic deflashing apparatus according to claim 15, wherein the conical surface is at an angle of about 22° relative to the perforated shell of the basket.

18. A cryogenic deflashing apparatus according to claim 15, wherein the shot collection basket includes a pick-up tube having an opening therein for smoothing the delivery of the shot media to the throw wheel.

19. A cryogenic deflashing apparatus according to claim 15, wherein the cryogenic chamber includes an entry port for delivery of the shot media to the parts basket that is displaced from an axis of rotation of the parts basket to direct the shot media along internal surfaces of the parts basket perforated shell.

20. A cryogenic deflashing apparatus according to claim 15, wherein the shot collection hopper includes a pick-up tube having a first opening therein below a level of the shot in the hopper and a second opening above the level of the shot for smoothing the delivery of the shot media to the throw wheel.

21. A cryogenic deflashing apparatus according to claim 15 wherein the throw wheel has an odd number of vanes for accelerating the shot media within the parts basket.

22. A cryogenic deflashing apparatus according to claim 15, further including a door for the cryogenic chamber having an inner seal that is protected from the shot media in the cryogenic chamber and has at least one seal surface that does not adhere to ice.

23. A cryogenic deflashing apparatus according to claim 15, wherein component parts of said apparatus are sized to permit movement of said apparatus between production lines for said molded articles.

* * * * *